US007180022B1

(12) United States Patent
Chiu

(10) Patent No.: US 7,180,022 B1
(45) Date of Patent: Feb. 20, 2007

(54) ILLUMINATED KEYPAD

(75) Inventor: Chin-Te Chiu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/221,286

(22) Filed: Sep. 6, 2005

(51) Int. Cl.
*H01H 9/18* (2006.01)

(52) U.S. Cl. ..... 200/313; 200/310

(58) Field of Classification Search ..... 200/310, 200/313, 314, 317
See application file for complete search history.

(56) References Cited

U.S. PATENT DOCUMENTS 3,856,127 A * 12/1974 Halfon et al.. ..... 400/479
4,636,593 A * 1/1987 Novak et al. ..... 200/5 A
4,706,218 A * 11/1987 Sodd ..... 365/189.05
4,772,769 A * 9/1988 Shumate ..... 200/314
5,083,240 A * 1/1992 Pasco ..... 362/26
5,491,313 A * 2/1996 Bartley et al. ..... 200/310
5,708,428 A * 1/1998 Phillips ..... 200/314
5,710,398 A * 1/1998 Hassler et al. ..... 200/5 A
5,826,708 A * 10/1998 Finlay ..... 200/314

* cited by examiner

*Primary Examiner*—Elvin Enad
*Assistant Examiner*—M. Fishman

(57) ABSTRACT

An illuminated keypad includes a baseboard, a plurality of keys protruded from the baseboard, a plurality of sets of light guiding bars and a plurality of light-emitting components. Each set of light guiding bars is disposed under the baseboard. Each light guiding bar has a portion extending toward one key. The light-emitting components are disposed under the baseboard corresponding to the respective sets of light guiding bars. Thus light emitted from the light-emitting components is transmitted to the keys for illuminating through the respective light guiding bars. According to an aspect of the invention, each set of light guiding bars are arranged to be X-shaped. According to another aspect of the invention, each set of light guiding bars are arranged in a line.

5 Claims, 4 Drawing Sheets

ILLUMINATED KEYPAD

BACKGROUND OF THE INVENTION

1. Field of the Invention

The present invention relates generally to a keypad, and more particularly, to an illuminated keypad capable of being used under a condition of poor light, such as at night.

2. The Related Art

A Keypad is widespread and used in various electronic devices, such as a mobile phone, a computer, a PDA (Personal Digital Assistant), etc. Under a condition of poor light, such as at night, it is also required that the keypad is conveniently recognized. So a keypad with illumination function is manufactured and is commonly used nowadays.

A traditional illuminated keypad of an electronic device has a baseboard. A plurality of keys arranged in array is integrally protruded from a top surface of the baseboard. A top surface of each key is a translucent layer and is manufactured by a silk-screen printing technique or Plastic Laser Etching. So light can be received by the translucent layers of the keys for illuminating. Each of the keys extends a projection portion downward to control a switch on a printed circuit board disposed under the baseboard. When assembling, the illuminated keypad is fixed to the printed circuit board of the electronic device, and a plurality of light-emitting components, such as LEDs, or LCDs, are positioned on the printed circuit board. The light-emitting components emit light to the translucent layers of the keys so as to provide enough light for users to distinguish alphanumeric characters printed on the keys.

However, because the light from the light-emitting components is transmitted and scattered in the air, some energy of the light is dissipated in the air and results in inadequate illumination of the keypads, which in turn results in difficulty to recognize the alphanumeric characters printed on the keys.

In order to solve the above questions, there discloses another improved illuminated keypad having a light guide plate. The light guide plate is disposed under the baseboard of the keypad, and the projection portions of the keys penetrate the light guide board. The light guide plate is made of substantially light conducting material. A plurality of light-emitting components is disposed inside the light guide plate. Light emitted from the light-emitting components is reflected by many times inside the light guide plate, and then is transmitted to the top surface of the keys, so the keys are illuminated for users distinguishing the alphanumeric characters printed on the keys.

However, it is disadvantage of the improved illuminated keyboard with a light guide plate. Because the light is transmitted inside a large space of the light guide plate and reflected by the light guide plate for many times before being transmitted to the keys, some energy of the light is also dissipated in the course of transmitting and reflection. This results in lower efficiency of light energy utilization. Additionally, the large area of the total light guide plate increases manufacturing cost.

SUMMARY OF THE INVENTION

An object of the present invention is to provide an illuminated keypad capable of being used under conditions of poor light. The illuminated keypad comprises a horizontal baseboard, a plurality of keys, at least one set of light guiding bars disposed under the baseboard, and at least one light-emitting component disposed under the baseboard corresponding to the set of light guiding bars. The horizontal baseboard has a top surface and a bottom surface opposite to the top surface. The keys are formed on the baseboard and arranged in array. Each key has an upper portion bulged out of the top surface of the baseboard and a lower portion extending beyond the bottom surface of the baseboard. Each light guiding bar has a portion extending toward one of the keys. Light emitted from the light-emitting component is transmitted to the keys for illuminating through the light guiding bars.

As described above, the light emitted from the light-emitting components is directly transmitted to the keys through the light guiding bars without scattering, so the light energy is centralized without dissipation, and the efficiency of energy utilization is improved.

Additionally, the light guiding bars disposed around the keys strengthen the structure of the keypad to resist pressure thereon, thereby increasing the duration of the keypad for long-term usage.

It is enough to arrange one light-emitting component for one set of light guiding bars. So the amount of the light-emitting components disposed in the keypad is reduced, and the manufacturing cost is accordingly reduced.

The above-mentioned and other features and objects of this invention and the manners of attaining them will become more apparent and the invention itself will be better understood by reference to the following description of preferred embodiments of the invention taken in conjunction with the accompanying figures, wherein:

DETAILED DESCRIPTION OF THE PREFERRED EMBODIMENTS

Figure 1:
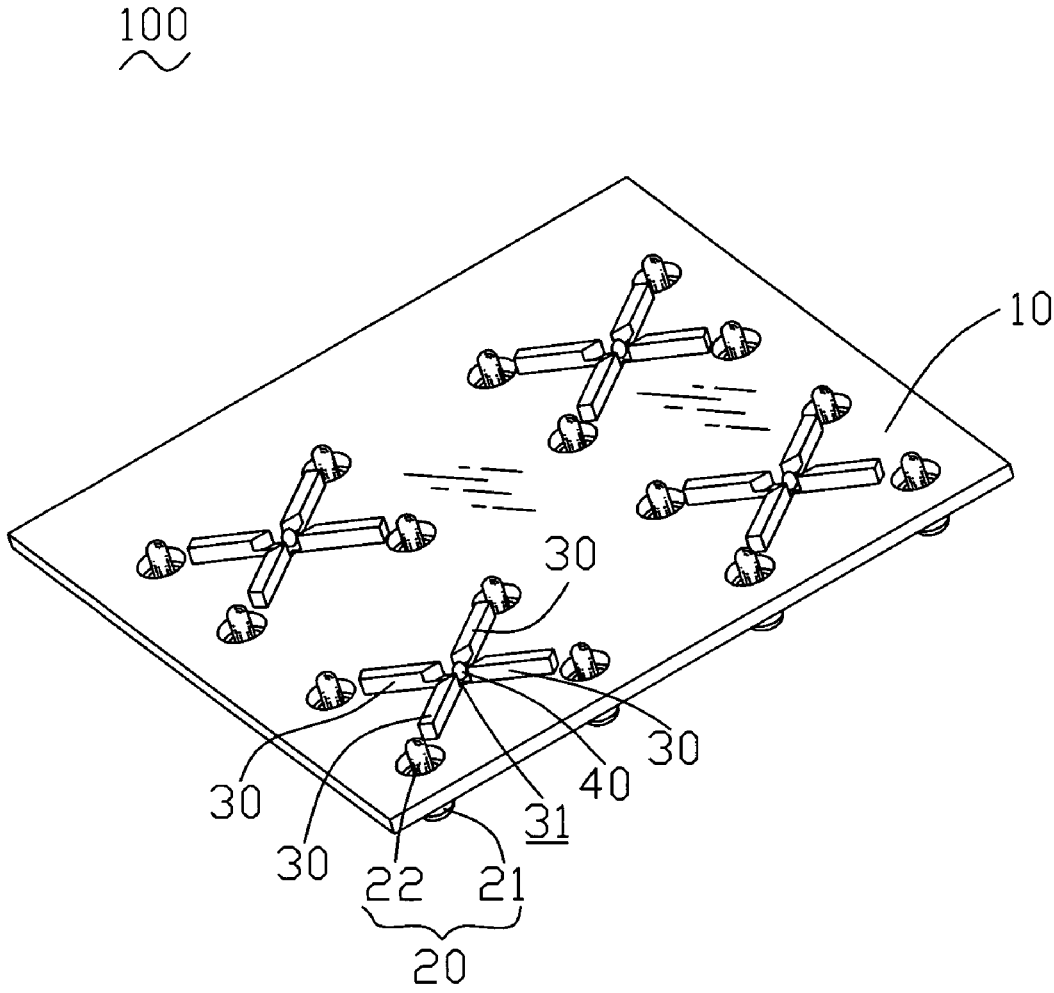
FIG. 1 is a perspective view of an illuminated keypad of a first embodiment according to the present invention.

While the present invention is susceptible of embodiment in various forms, as shown in the drawings, hereinafter will be described the presently preferred embodiments of the invention with the understanding that the present disclosure is to be considered as an exemplification of the invention, and is not intended to limit the invention to specific embodiments illustrated.

Referring to FIG. 1, the illuminated keypad 100 comprises a rectangular horizontal baseboard 10 having a top surface and a bottom surface opposite to the top surface. A plurality of keys 20 is formed on the baseboard 10 with arrangement in array. Each key 20 has a domed upper potion 21 bulged out of the top surface of the baseboard 10 and a lower portion 22 projected downward from a middle portion of the upper portion 21. A top surface of the upper portion 21 is made of translucent light conducting material and printed with alphanumeric characters. The lower portion 22 of each key 20 extends beyond the bottom surface of the baseboard 10 to control an electrical switch (not shown) on a printed circuit board (not shown) that is disposed under the baseboard 10. The keys 20 move up and down while pressure forces are exerted upon the keys 20.

Plural sets of light guiding bars 30 are disposed under the baseboard 10. Each set of the light guiding bars 30 is arranged to be X-shaped. Each set of light guiding bars 30 includes four light guiding bars 30 arranged on diagonal lines of the X-shaped arrangement. Four free ends of the X-shaped light guiding bars extend towards four keys 20. The X-shaped light guiding bars 30 meet at a crossing to define a recess 31. The light guiding bars 30 are made of substantially translucent light conducting material, and each light guiding bar 30 is a hollow rectangular pipe. A light-emitting component 40 is positioned at the crossing, preferably in the recess 31, of the X-shaped light guiding bars for emitting light to four light guiding bars. The volume of the hollow rectangular pipe is matched with that of the light-emitting component 40.

While pressing the keys 20, the light-emitting components 40 emit light to the light guiding bars 30. The light is pervious to the light guiding bars 30 and then is transmitted inside the light guiding bars 30 in a straight line. So the light is directly transmitted without scattering to the keys 20 and further transmitted to the translucent top surfaces of the keys 20. Thus, users can distinguish alphanumeric characters printed on the keys 20 by the bright light.

Figure 2:
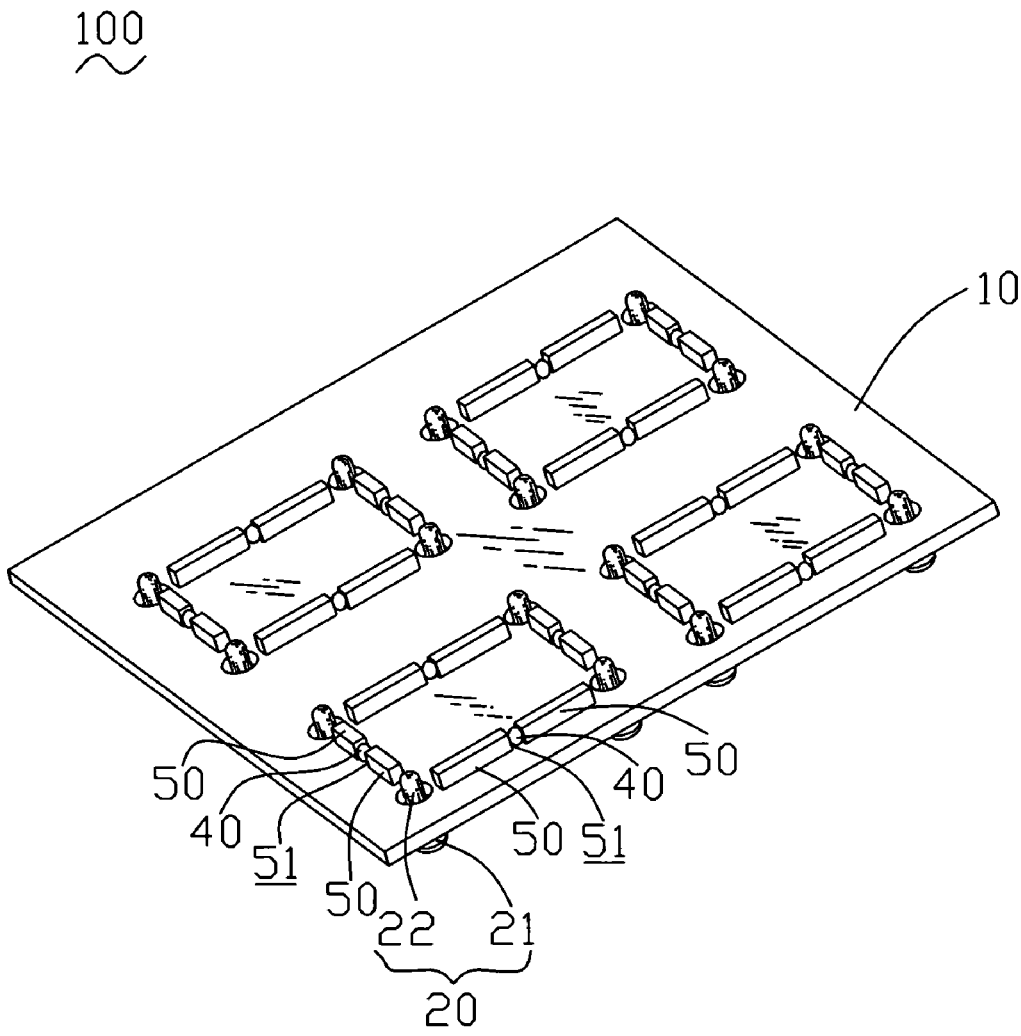
FIG. 2 is a perspective view of an illuminated keypad of a second embodiment according to the present invention.

Referring to FIG. 2, every four adjacent keys 20 consist of a rectangular matrix, four sets of light guiding bars 50 are disposed in each rectangular matrix along sides thereof. Each set of light guiding bars 50 includes two light guiding bars 50 arranged in a line between two adjacent keys 20. Two opposite ends of two light guiding bars 50 on the line extend toward two keys 20, and the other two adjacent ends of two light guiding bars 50 meet at the middle of the line to define a cave 51. A light-emitting component 40 is disposed between two light guiding bars 50, preferably in the cave 51. The light-emitting component 40 emits light to the light guiding bars 50 and then is transmitted to the keys 20 for illumination.

Figure 3:
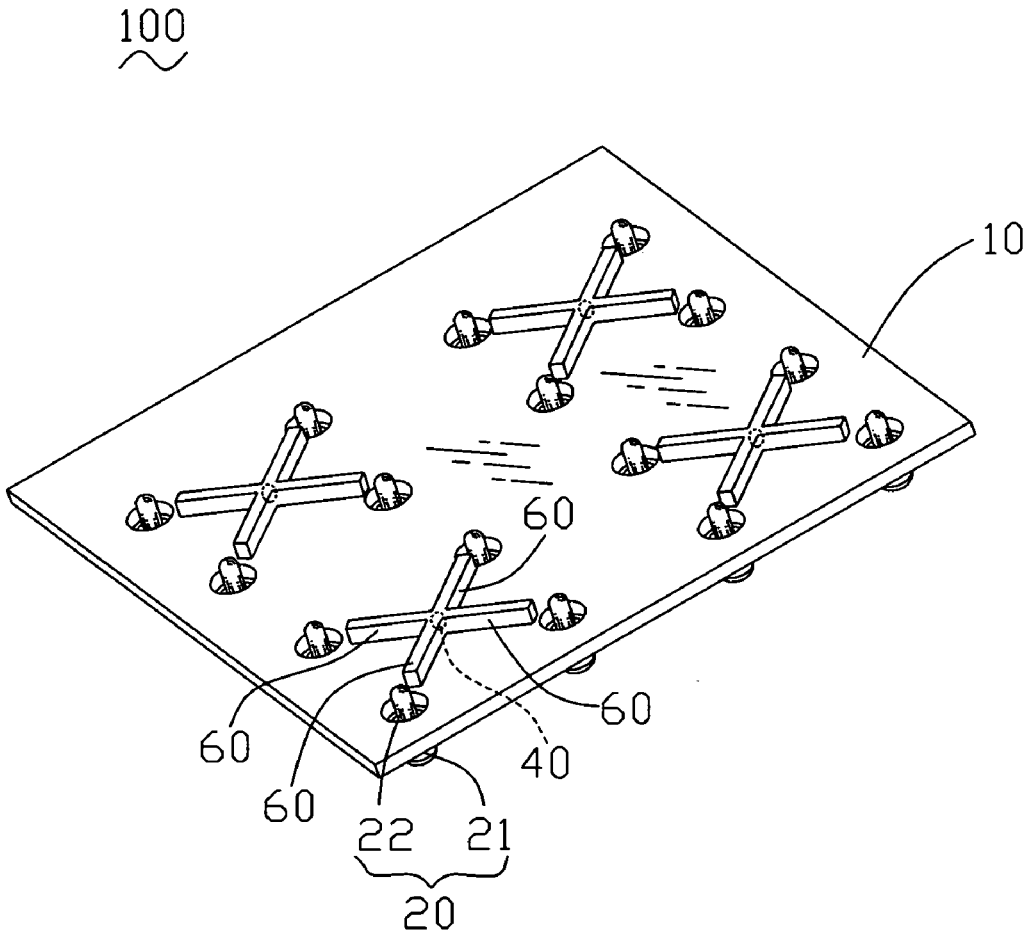
FIG. 3 is a perspective view of an illuminated keypad of a third embodiment according to the present invention.

Referring to FIG. 3, showing a third embodiment of the present invention, the difference between the configuration of FIG. 3 and the configuration of FIG. 1 is that an X-shaped light guiding bars 60 in the FIG. 3 is integrally molded. The X-shaped light guiding bars 60 consist of four light guiding bars 60 that meet at a crossing of the X-shaped light guiding bars 60. The light-emitting component 40 is disposed at the crossing of the X-shaped light guiding bars 60. The light-emitting component 40 emits light, and the light communicates with each light guiding bar 60.

Figure 4:
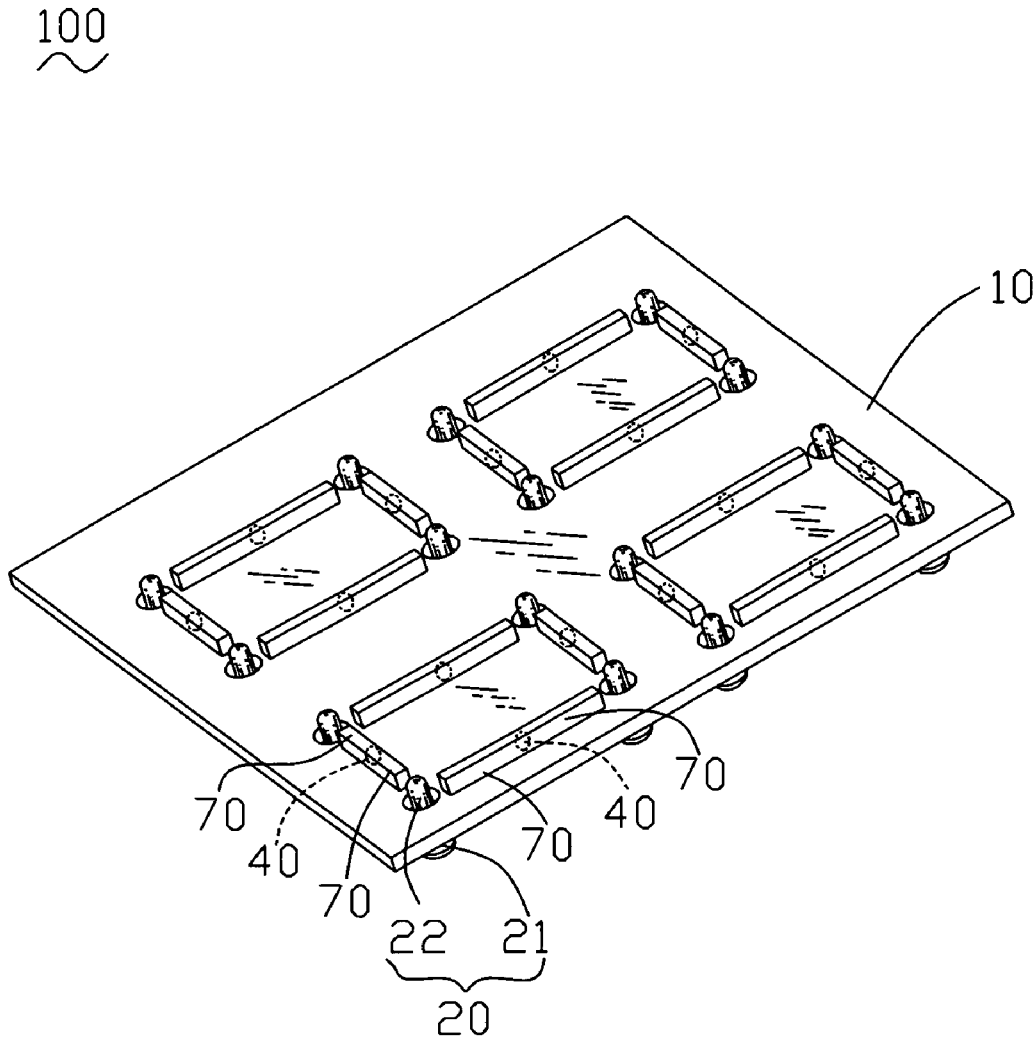
FIG. 4 is a perspective view of an illuminated keypad of a fourth embodiment according to the present invention.

Referring to FIG. 4, showing a fourth embodiment, compared to the second embodiment, the difference between the two embodiments is that the two light guiding bars 70 in FIG. 4 arranged in a line between two keys 20 are integrally molded. The light-emitting component 40 is disposed in the middle of the light guiding bars 70.

According to the present invention, the light guiding bars 30, 50, 60, 70 are designed to be located among several adjacent keys 20, and the light-emitting component 40 is disposed among the light guiding bars 30, 50, 60, 70. The light emitting component 40 emits light to the light guiding bars 30, 50, 60, 70, and in other words, the light is simply transmitted inside the light guiding bar 30, 50, 60, 70 in a straight line to provide adequate and uniform light source to the keys 20. So light scattering is avoided, and the efficiency of light energy utilization is improved.

Additionally, the light guiding bars 30, 50, 60, 70 are disposed around the keys 20, so structure of the keypad 100 is strengthened to resist pressure. Therefore the keypad 100 is durable for long-term usage.

It can also be seen from the above that, one set of light guiding bars 30, 50, 60, 70 needs only one light-emitting component 40. So the amount of the light-emitting components 40 disposed in the keypad 100 is reduced, and the manufacturing cost is accordingly reduced.

The present invention provides for an inexpensive and simple way to manufacture an illuminated keypad. While several particular forms of the invention have been illustrated and described, it will be apparent that various modifications can be made without departing from the spirit and scope of the invention. Accordingly, it is intended that this invention be limited only by the scope of the appended claims.

What is claimed is:

1. An illuminated keypad comprising:

a horizontal baseboard having a top surface and a bottom surface opposite to the top surface;

a plurality of keys formed on the baseboard and arranged in array, each key having an upper portion bulged out of the top surface of the baseboard and a lower portion extending beyond the bottom surface of the baseboard;

at least two light guiding bars disposed under the baseboard and positioned orthogonally against each key, the light guiding bars between every two adjacent keys being positioned in a line; and at least one light-emitting component disposed under the baseboard between every two adjacent light guiding bars that are positioned in a line between two adjacent keys;

whereby lights emitted from the light-emitting components are transmitted to said keys for illuminating through the light guiding bars.

2. The illuminated keypad as claimed in claim 1, wherein every two adjacent light guiding bars that are positioned in a line between two adjacent keys are integrally molded.

3. The illuminated keypad as claimed in claim 2, wherein a recess is defined in the middle of the integrally molded light guiding bars, and said at least one light-emitting component is disposed inside the recess.

4. The illuminated keypad as claimed in claim 1, wherein each of the light guiding bars is a hollow rectangular pipe, and a volume of the hollow rectangular pipe is matched with that of each of the light-emitting components.

5. The illuminated keypad as claimed in claim 1, wherein the light guiding bars are integrally molded with said baseboard.

* * * * *